US012593922B2

(12) United States Patent
Hsieh

(10) Patent No.: US 12,593,922 B2
(45) Date of Patent: Apr. 7, 2026

(54) SEAT ARMREST

(71) Applicant: Wen-Ping Hsieh, Taichung City (TW)

(72) Inventor: Wen-Ping Hsieh, Taichung City (TW)

( * ) Notice: Subject to any disclaimer, the term of this patent is extended or adjusted under 35 U.S.C. 154(b) by 152 days.

(21) Appl. No.: 18/613,158

(22) Filed: Mar. 22, 2024

(65) Prior Publication Data

US 2024/0407555 A1 Dec. 12, 2024

(30) Foreign Application Priority Data

Jun. 9, 2023 (TW) ..... 112121685

(51) Int. Cl.
*A47C 7/54* (2006.01)

(52) U.S. Cl.
CPC ..... *A47C 7/541* (2018.08)

(58) Field of Classification Search
CPC ..... A47C 1/0305; A47C 1/0303; A47C 7/541
See application file for complete search history.

(56) References Cited

U.S. PATENT DOCUMENTS 5,382,079 A * 1/1995 Wilson ..... A47C 1/03 297/411.36
6,209,961 B1 * 4/2001 Chen ..... A47C 1/03 297/411.36
7,360,839 B1 * 4/2008 Chen ..... A47C 1/0308 297/411.36
2021/0315382 A1 * 10/2021 Hsieh ..... A47C 1/0305

* cited by examiner

*Primary Examiner* — Nicholas McFall
*Assistant Examiner* — Eric Acosta

(57) ABSTRACT

A seat armrest is provided. The seat armrest includes a support unit, having a fixed seat and a support rod extending upward from the fixed seat; wherein the support rod has an accommodation space, and the support pole is provided with a positioning slot section composed of a vertical displacement slot and a plurality of horizontal displacement slots communicated with each other; a casing unit, sleeved around the support rod and having an installation groove communicated with the accommodation space; and an adjusting rod, having a positioning protrusion and being pivot disposed on the installation groove of the casing unit.

6 Claims, 11 Drawing Sheets

SEAT ARMREST

FIELD OF THE DISCLOSURE

The present disclosure is related to the technical field related to a seat armrest, in particular to an adjustable armrest height seat armrest.

BACKGROUND OF THE DISCLOSURE

Most of the existing seat armrests are fixed and cannot adjust the armrest height. However, when working, meeting, or taking transportation, it is generally necessary to sit on the seat for a long time. The inability to adjust the armrests of the seat in height according to the user's body shape can easily cause fatigue and affect the body's health. Therefore, how to solve the above deficiencies is one of the important issues of the present disclosure.

SUMMARY OF THE DISCLOSURE

The present disclosure is related to a seat armrest. The main purpose of the present disclosure is to prevent the adjusting rod from being exposed to the long-term resistance force of the user's arm, causing the positioning protrusion and the horizontal displacement slot to become loose, thereby preventing the user from being injured.

Therefore, in order to achieve the above-mentioned objectives and effects, a seat armrest is provided. The seat armrest includes a support unit, having a fixed seat and a support rod extending upward from the fixed seat; wherein the support rod has an accommodation space inside, and the wall surface of the support pole is provided with a positioning slot section composed of a vertical displacement slot and a plurality of horizontal displacement slots communicated with each other; a casing unit, sleeved around the support rod of the support unit, and having a hollow installation groove extending outward from a top of the casing unit; wherein the installation groove is communicated with the accommodation space of the support rod; and an adjusting rod, accommodated and pivoted in the accommodation space of the support rod; wherein the adjusting rod has a positioning protrusion, and a top being pivoted inside the installation groove of the casing unit; wherein each of the horizontal displacement slots has an inclined section, the aperture of the inclined section gradually decreases toward the vertical displacement slot, so that the positioning protrusion can be firmly positioned in the horizontal displacement slot.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Referring to FIGS. 1-11, the seat armrest of the present disclosure includes a support unit 1, a casing unit 2, and an adjusting rod 3.

Figure 1:
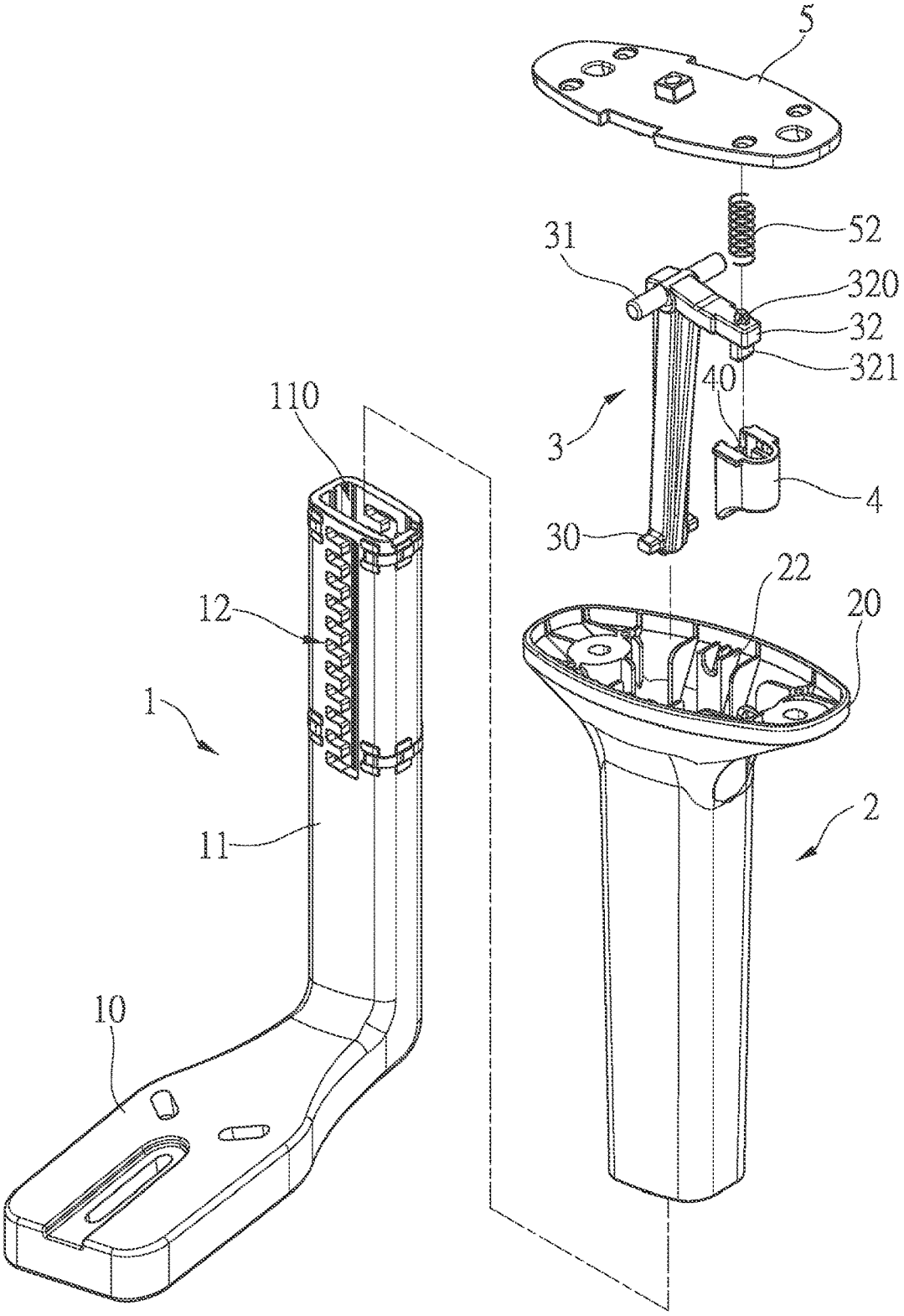
FIG. 1 is an exploded perspective schematic view of the button disconnecting the connecting rod of the adjusting rod.
Figure 2:
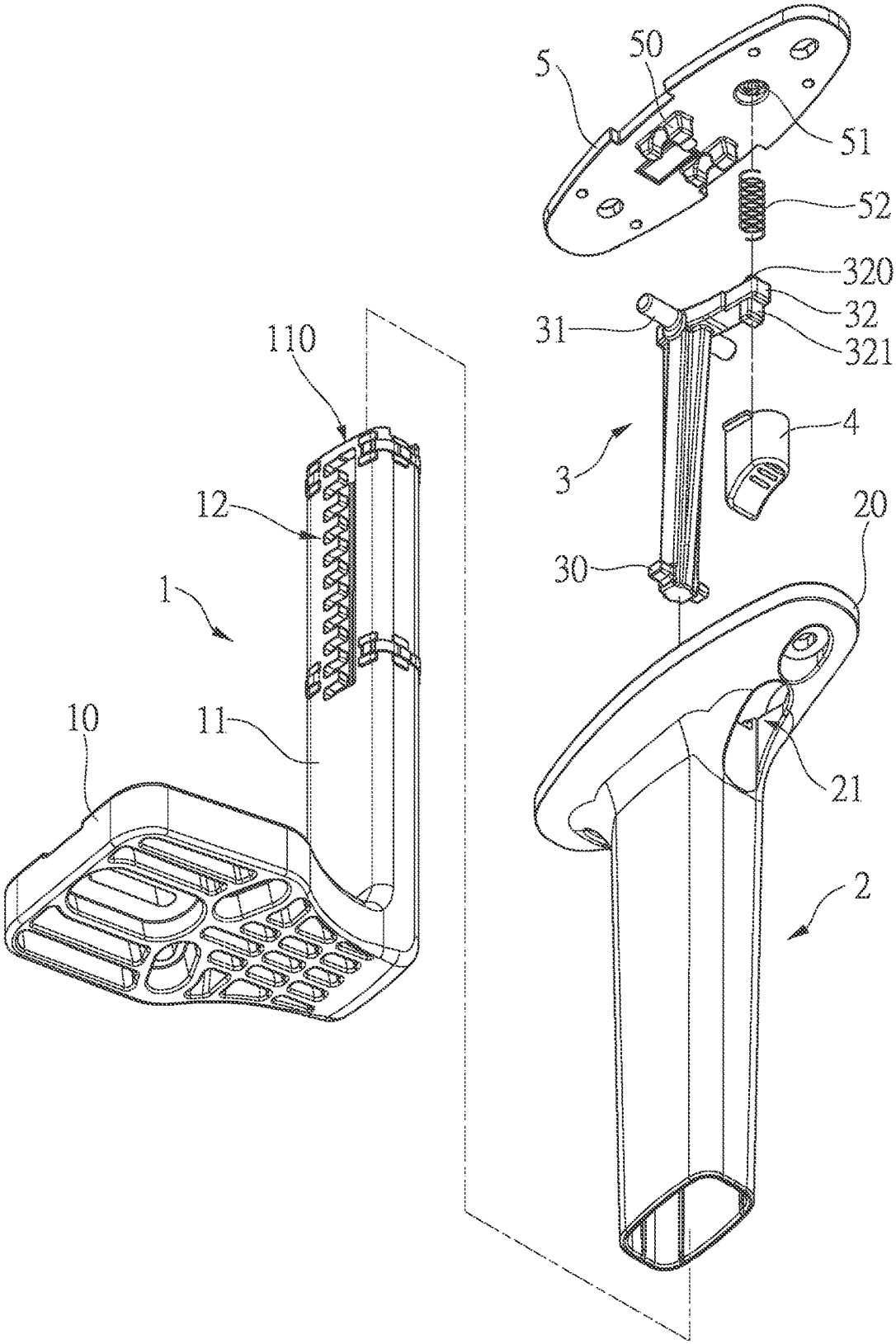
FIG. 2 is an exploded perspective schematic view of another angle of FIG. 1 of the present disclosure.
Figure 3:
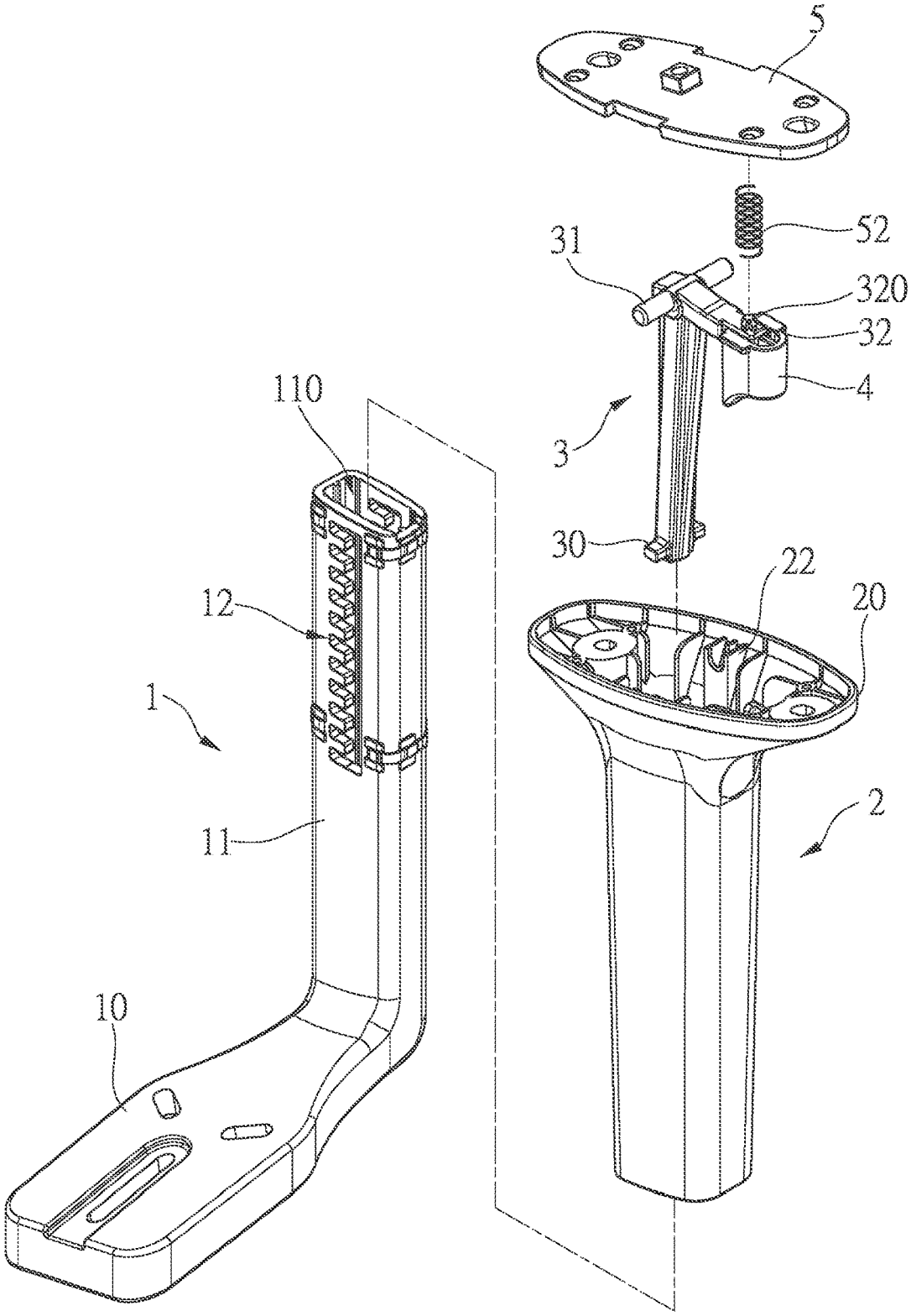
FIG. 3 is an exploded perspective schematic view of the button connecting the connecting rod of the adjusting rod.
Figure 4:
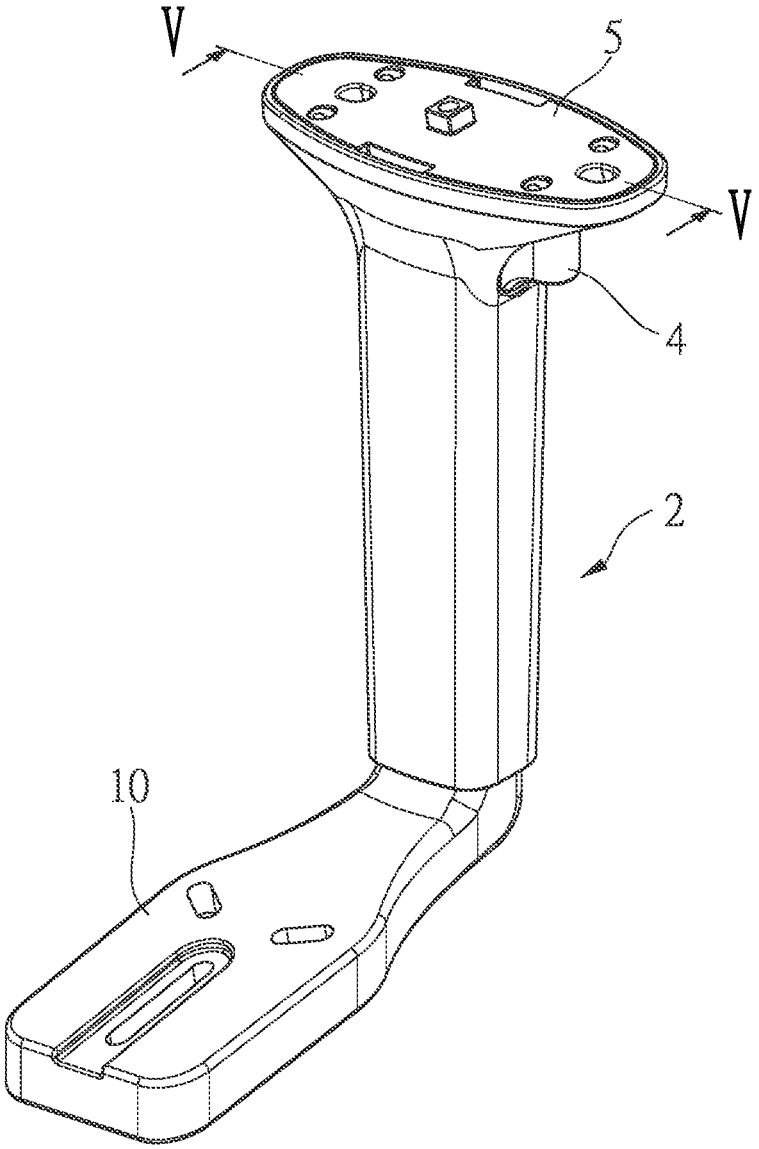
FIG. 4 is an assembled perspective schematic view of the present disclosure.
Figure 5:
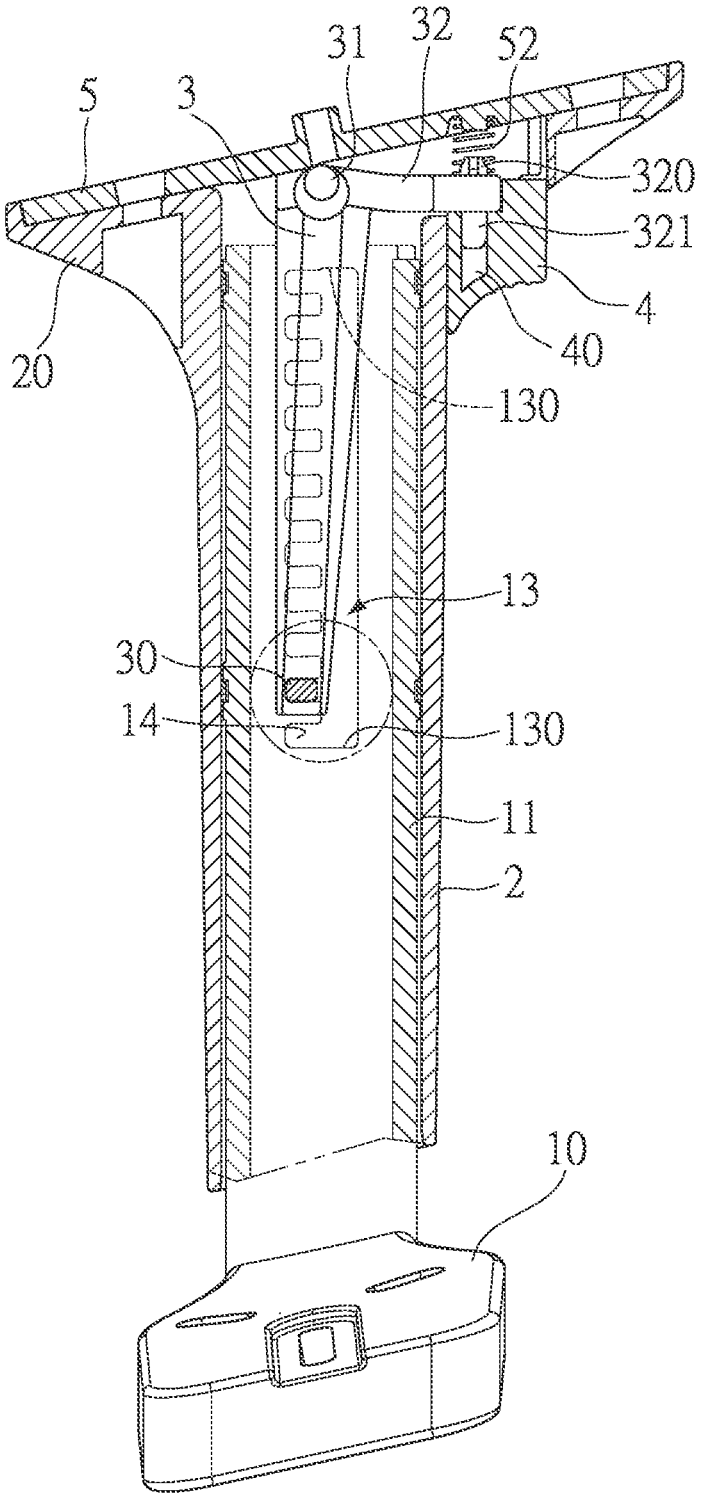
FIG. 5 is a sectional schematic view of line V-V of FIG. 4 of the present disclosure.
Figure 6:
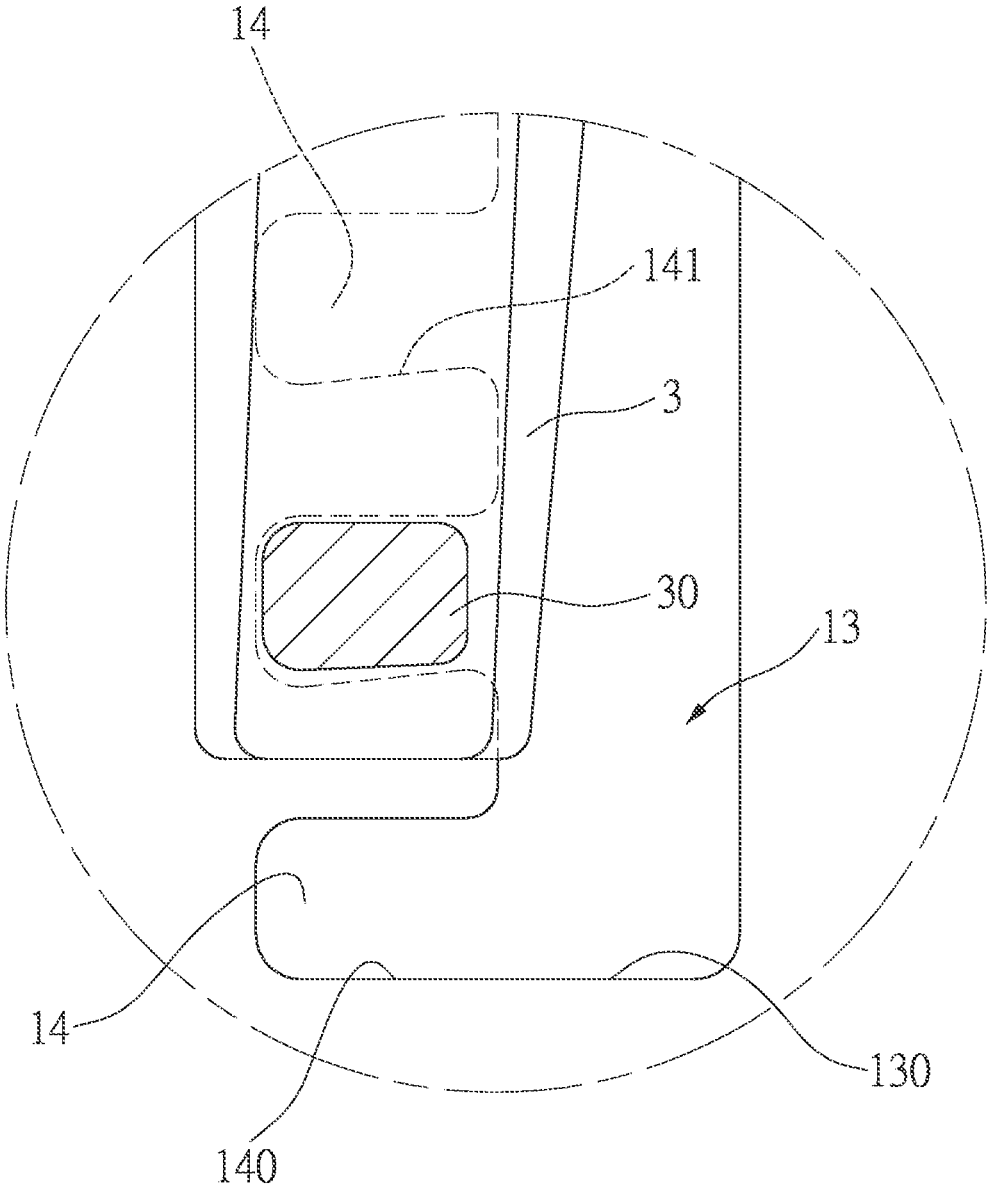
FIG. 6 is a partially enlarged schematic view of FIG. 5.
Figure 7:
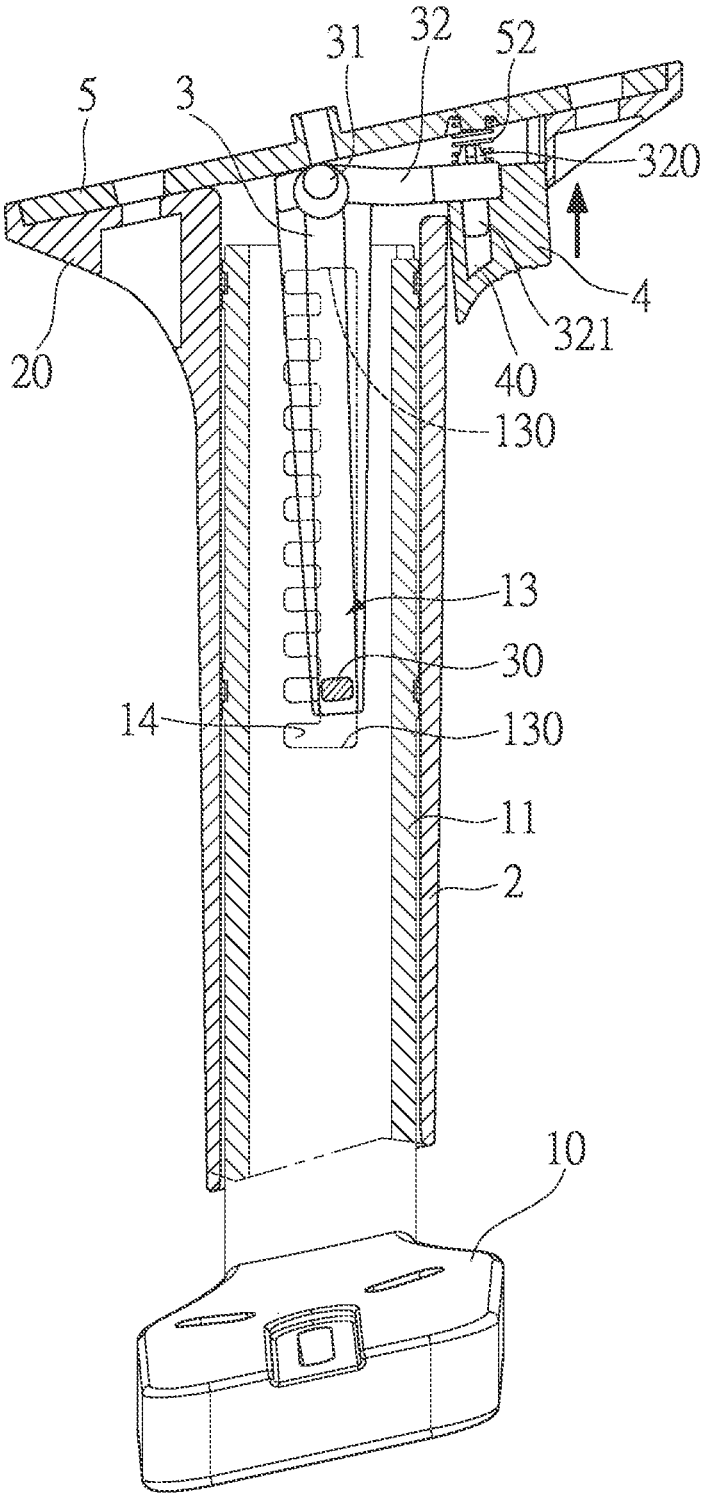
FIG. 7 is a first sectional schematic view of the present disclosure.
Figure 8:
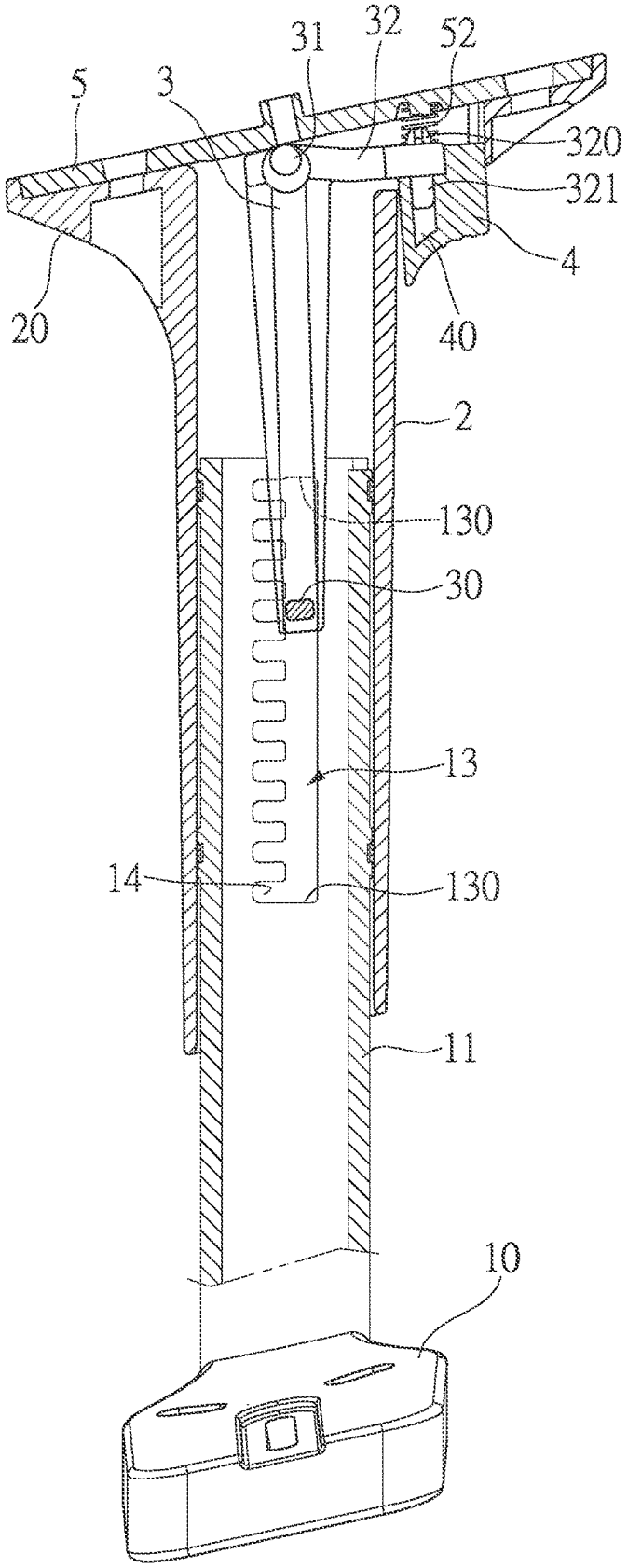
FIG. 8 is a second sectional schematic view of the present disclosure.
Figure 9:
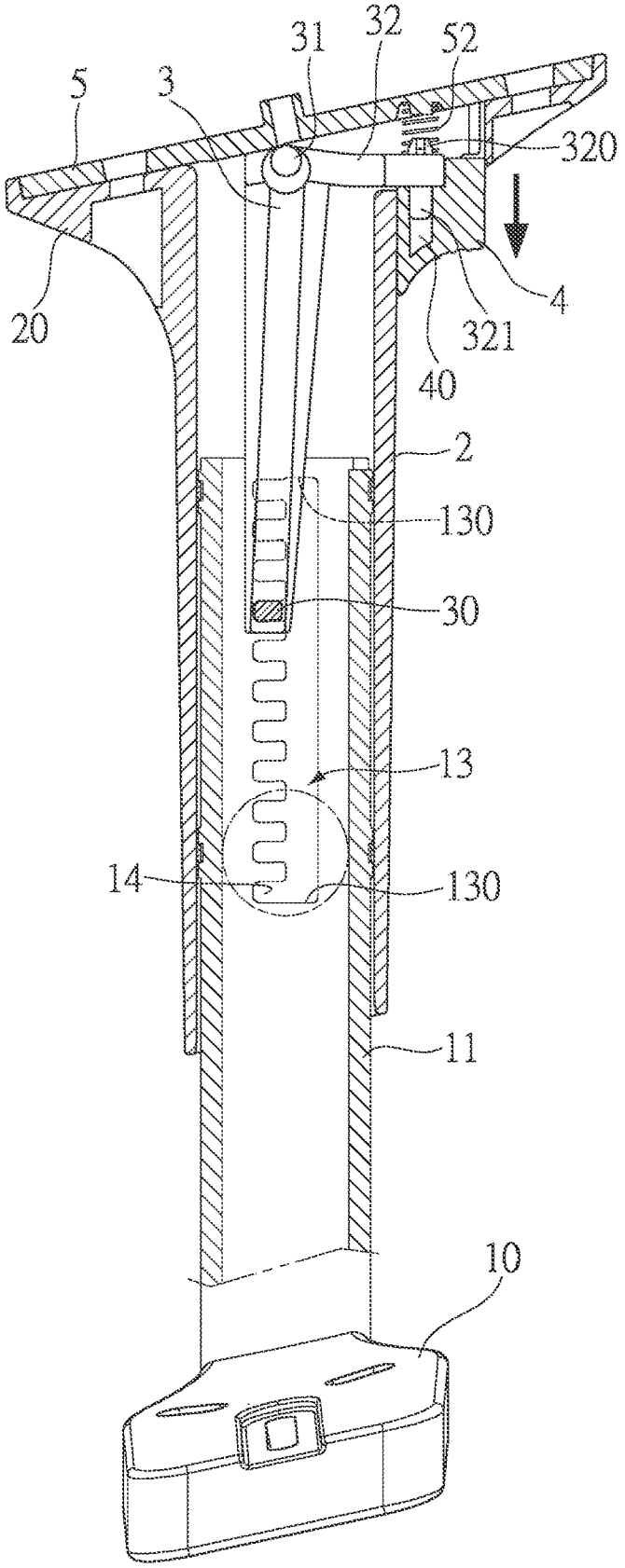
FIG. 9 is a third sectional schematic view of the present disclosure.
Figure 11:
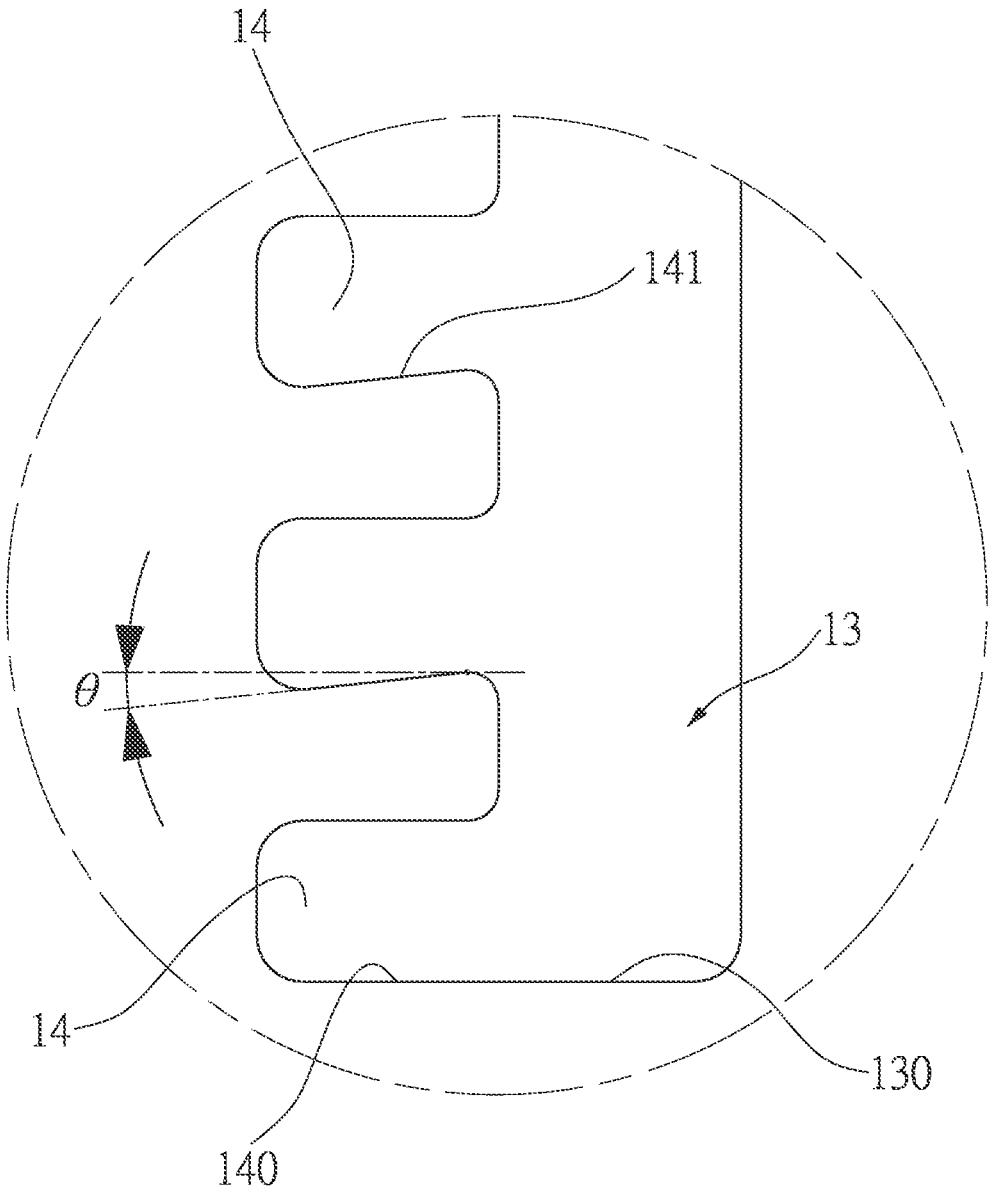
FIG. 11 is a partially enlarged schematic view of FIG. 9 for the present disclosure.

The support unit 1 has a fixed seat 10 and a support rod 11 extending upward from the fixed seat 10. The support rod 11 has an accommodation space 110 inside, and the wall surface of the support pole is provided with a positioning slot section 12 composed of a vertical displacement slot 13 and a plurality of horizontal displacement slots 14., a top end and a bottom end of the vertical displacement slot 13 form a closed section 130. Each of the plurality of horizontal displacement slots 14 is communicated with the vertical displacement slot 13. In detail, the horizontal displacement slot 14 at the bottom of the positioning slot section 12 has a straight section 140 with the same aperture formed from the open end to the closed end. The other horizontal displacement slot 14 has an inclined section 141 with a gradually expanding aperture from the open end toward the closed end. The angle of the inclined section 141 is from 3 to 6 degrees, as shown in FIG. 6 and FIG. 11.

The casing unit 2 is sleeved around the support rod 11 of the support unit 1, and has a hollow installation groove 20 extending outward from a top of the casing unit 2. The inner side of the installation groove 20 is communicated with the accommodation space 110 of the support rod 11. The installation groove 20 has a buttonhole 21 and a first pivot portion 22 on the inner wall of the installation groove 20.

The adjusting rod 3 is accommodated and pivoted in the accommodation space 110 of the support rod 11. The adjusting rod 3 has a positioning protrusion 30. The adjusting rod 3 has a pivot rod 31 and a connecting rod 32 in different axial directions on the top of the adjusting rod 3. The positioning protrusion 30 can be positioned in or disengaged from each horizontal displacement slot 14 of the positioning slot section 12. The pivot rod 31 is pivot disposed on the first pivot portion 22 of the installation groove 20 of the casing unit 2. The connecting rod 32 has a first fixed portion 320 and a connecting rod 321 respectively protruding from the upper and lower side of the connecting rod 32.

A button 4 is disposed into a buttonhole 21 of the installation groove 20 of the casing unit 2 and has a connecting groove 40. The connecting groove 40 of the button 4 and connecting portion 321 of the connecting rod 32 of the adjusting rod 3 are connected.

Further, a cover plate 5 is covered on the installation groove 20 of the casing unit 2. The cover plate 5 has a second pivot portion 50 and a second fixed portion 51 corresponding to the first pivot portion 22 of the installation groove 20 of the casing unit 2 and the first fixed portion 320 of the connecting rod 32 of the adjusting rod 3. Further, an elastic member 52 is disposed between the first fixed portion 320 of the connecting rod 32 of the adjusting rod 3 and the second fixed portion 51 of the cover plate 5. In one embodiment, the elastic member 52 is a spring.

Further, the assembly structure of the seat armrest of the present disclosure is presented.

Firstly, the fixed seat 10 of the support unit 1 is connected to a chair (not shown in the figure). The casing unit 2 is disposed on the support rod 11 of the support unit 1, and then the adjusting rod 3 is inserted from the installation groove 20 of the casing unit 2 and located in the accommodation space 110 of the support rod 11. The pivot rod 31 of the adjusting rod 3 is pivot disposed between the first pivot portion 22 of the installation groove 20 and the second pivot portion 50 of the cover plate 5. A button 4 is disposed into a buttonhole 21 of the installation groove 20 of the casing unit 2. The connecting groove 40 of the button 4 and connecting portion 321 of the connecting rod 32 of the adjusting rod 3 are connected. Further, an elastic member 52 is disposed between the first fixed portion 320 of the connecting rod 32 of the adjusting rod 3 and the second fixed portion 51 of the cover plate 5. The cover plate 5 is covered on the installation groove 20 of the casing unit 2.

Furthermore, adjusting the height of the seat armrest of the present disclosure is presented.

Referring to FIGS. 7-10, press the button 4 for adjusting the height of the armrest. The button 4 pushes the connecting rod 32 of the adjusting rod 3 to move upward. At this time, the elastic member 52 between the connecting rod 32 of the adjusting rod 3 and the cover plate 5 is in a compressed state. When the connecting rod 32 of the adjusting rod 3 moves upward, the adjusting rod 3 will swing toward the vertical displacement slot 13 of the positioning slot section 12, so that the positioning protrusion 30 of the adjusting rod 3 is separated from each horizontal displacement slot 14 of the positioning slot section 12. At this time, the casing unit 2 and the support rod 11 are in a loose state, and the casing unit 2, the adjusting rod 3, and the cover plate 5 can be pulled upward or downward together. After adjusting the armrest to the appropriate height, release the button 4, and the elastic release of the elastic member 52 drives the connecting rod 32 of the adjusting rod 3 to move downward. When the connecting rod 32 of the adjusting rod 3 moves downward, the adjusting rod 3 will swing toward the horizontal displacement slot 14 of the positioning slot section 12, so that the positioning protrusion 30 of the adjusting rod 3 is engaged to one of the horizontal displacement slot 14 of the positioning slot section 12. At this time, the casing unit 2 and the support rod 11 form a fixed state.

Figure 10:
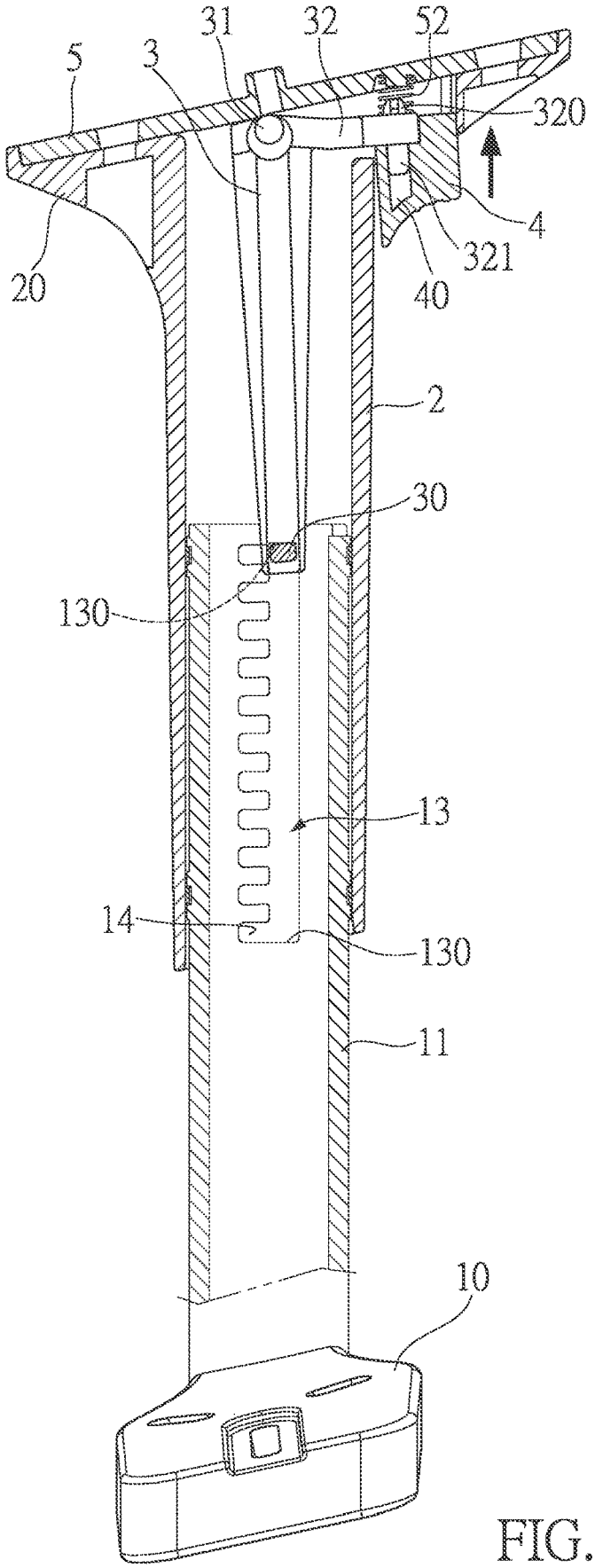
FIG. 10 is a fourth sectional schematic view of the present disclosure.

Furthermore, referring to FIG. 10, due to the design of the closed section 130 at the top of the vertical displacement slot 13, the positioning protrusion 30 of the adjusting rod 3 will be blocked by the closed section 130 when the casing unit 2 is being pulled upward, so as to avoid the trouble of the casing unit 2 detaching from the support rod 11 by excessive force.

It is worth mentioning that, among the positioning slot section 12 of the support rod 11, except for the bottom one of the horizontal displacement slot 14 has the same diameter, other horizontal displacement slots 14 have an inclined section 141 with any inclination angle θ of 3 degrees, 4 degrees, 5 degrees, or 6 degrees. The aperture of the inclined section 141 is gradually expanded in the opposite direction from the vertical displacement slot 13. The inclined section 141 of the horizontal displacement slot 14 can improve the smoothness when the positioning protrusion 30 of the adjusting rod 3 enters each horizontal displacement slot 14. In addition, the inclination angle of the hole diameter of each horizontal displacement slot 14 gradually decreases toward the open end (the position of the vertical displacement slot 13), which can increase the positioning effect of the positioning protrusion 30 of the adjusting rod 3 to the horizontal displacement slot 14. After the height of the casing unit 2 is adjusted, this structure can prevent the positioning protrusion 30 of the adjusting rod 3 from accidentally disengaging from the horizontal displacement slot 14, and causing the casing unit 2 and the support rod 11 to become loose state.

In other words, the adjusting rod 3 of the seat armrest of the present disclosure will pivot in the accommodation space 110 of the support rod 11 only when the button 4 is being pressed or released. When the button 4 is pressed, the adjusting rod 3 moves toward the vertical displacement slot 13, so that the positioning protrusion 30 of the adjusting rod 3 is separated from the horizontal displacement slot 14. When the button 4 is released, the adjusting rod 3 moves toward the horizontal displacement slot 14, so that the positioning protrusion 30 of the adjusting rod 3 is positioned with one of the horizontal displacement slots 14. Accordingly, the seat armrest of the present disclosure provides the adjusting rod 3 to pivot left and right in the accommodation space 110 of the support rod 11, so that the positioning protrusion 30 of the adjusting rod 3 is positioned or disengaged to/from the horizontal displacement slot 14. Thereby the present disclosure achieves the purpose and effect of adjusting the height of the seat armrest.

As mentioned above, through the above structural configuration, the present disclosure provides the pivot rod 31 of the adjusting rod 3 to be pivoted between the second pivot portion 50 of the cover plate 5 and the first pivot portion 22 of the casing unit 2, the first pivot portion 22 and the second pivot portion 50 are pivotally clamped at the upper and lower ends of the pivot rod 31, so that the adjusting rod 3 has good stability when pivoting left and right. Moreover, the adjusting rod 3 is connected to the button 4 through the connecting portion 321 connecting to the connecting groove 40 of the button 4. Therefore, when the button 4 is pressed upward, the top surface of the button 4 is pushed against the bottom surface of the connecting rod 32, causing the adjusting rod 3 to achieve a tilting and swing effect. That is to say, by increasing the pressing area, not only improves the accuracy of the tilting of the adjusting rod 3, but also effectively reduces the pressing force, making it easier to adjust the height of the armrest. Further, the adjusting rod 3 and the button 4 of the present disclosure are two separate components rather than an integrally formed structure. Therefore, when the button 4 is damaged or deformed, the button 4 can be replaced separately without replacing the adjusting rod 3 together, which has the effect of reducing replacement costs.

Furthermore, it is worth mentioning that the horizontal displacement slots 14 have the structure with an inclined section 141, and the aperture of the inclined section 141 gradually decreases toward the open end (vertical displacement slot 13), due to most of the current armrest seats are made of plastic material, and users will rest their arms on the top of the armrest. This structure increases the positioning effect of the horizontal displacement slot 14 and the positioning protrusion 30, and prevents the adjusting rod from being exposed to the long-term resistance force of the user's arm, causing the positioning protrusion 30 and the horizontal displacement slot 14 to become loose. In other words, the design of the inclined section 141 of the horizontal displacement slot 14 of the present disclosure does have the effect of preventing the positioning protrusion 30 of the adjusting rod 3 from disengaging the horizontal displacement slot 14, thereby preventing the user from being injured.

What is claimed is:

1. A seat armrest, comprising:

a support unit, having a fixed seat and a support rod extending upward from the fixed seat; wherein the support rod has an accommodation space inside, and a wall surface of the support pole is provided with a positioning slot section composed of a vertical displacement slot and a plurality of horizontal displacement slots communicated with each other, a casing unit, sleeved around the support rod of the support unit, and having a hollow installation groove extending outward from a top of the casing unit; wherein the installation groove is communicated with the accommodation space of the support rod;

an adjusting rod, accommodated and pivoted in the accommodation space of the support rod; wherein the adjusting rod has a positioning protrusion, and a top being pivoted inside the installation groove of the casing unit; and wherein the installation groove of the casing unit has a buttonhole and a first pivot portion on an inner wall; wherein the adjusting rod has a pivot rod and a connecting rod in a different axial direction on the top of the adjusting rod; wherein the connecting rod has a first fixing rod and a connecting rod respectively protruding from an upper side and a lower side of the connecting rod;

wherein a button is disposed into a buttonhole of the installation groove of the casing unit and connected to the connecting rod of the adjusting rod;

wherein the button has a connecting groove corresponding to the connecting portion of the connecting rod, and the connecting groove of the button is connected to the connecting portion of the connecting rod;

wherein each of the horizontal displacement slots has an inclined section, the aperture of the inclined section gradually decreases toward the vertical displacement slot, so that the positioning protrusion can be firmly positioned in the horizontal displacement slot.

2. The seat armrest according to claim 1, wherein a top end and a bottom end of the vertical displacement slot form a closed section.

3. The seat armrest according to claim 1, wherein an angle of the inclined section is 3 degrees, 4 degrees, 5 degrees, or 6 degrees.

4. The seat armrest according to claim 1, further including a cover plate, on the installation groove of the casing unit; wherein the cover plate has a second pivot portion and a second fixed portion corresponding to the first pivot portion of the installation groove and the first fixed portion of the connecting rod; wherein the pivot rod of the adjusting rod is pivot disposed between the first pivot portion of the installation groove and the second pivot portion of the cover plate.

5. The seat armrest according to claim 4, further including an elastic member disposed between the first fixed portion of the connecting rod and the second fixed portion of the cover plate.

6. The seat armrest according to claim 5, wherein the elastic member is a spring.

* * * * *